US006367719B1

(12) United States Patent
Wright

(10) Patent No.: US 6,367,719 B1
(45) Date of Patent: Apr. 9, 2002

(54) ELECTROMECHANICAL VALVE DRIVER CIRCUIT AND METHOD

(75) Inventor: Danny Orlen Wright, Cobb's Creek, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/420,705

(22) Filed: Oct. 19, 1999

Related U.S. Application Data

(60) Provisional application No. 60/105,242, filed on Oct. 22, 1998.

(51) Int. Cl.[7] ..... B05B 1/30

(52) U.S. Cl. ..... 239/585.1; 251/129.15; 123/490; 361/139; 361/154

(58) Field of Search ..... 239/69, 71, 585.1–585.5; 123/490; 251/129.15; 361/139, 152, 154, 187

(56) References Cited

U.S. PATENT DOCUMENTS 3,815,556 A * 6/1974 Jaulmes ..... 123/490
4,680,667 A * 7/1987 Petrie ..... 361/154
5,379,178 A * 1/1995 Graf et al. ..... 361/152
5,777,850 A 7/1998 Jakob et al. ..... 361/736
5,884,896 A * 3/1999 Kono et al. ..... 251/129.15
5,937,828 A * 8/1999 Watanabe ..... 123/490
5,947,090 A * 9/1999 Maeda ..... 123/490
6,069,783 A * 5/2000 Mount et al. ..... 361/154

FOREIGN PATENT DOCUMENTS

EP 0 412 685 A2 2/1991
EP 0 622 536 A2 11/1994

* cited by examiner

*Primary Examiner*—Andres Kashnikow
*Assistant Examiner*—Lisa Ann Douglas

(57) ABSTRACT

The present device provides a fuel injector including a two-input, self-triggering monostable driver circuit for an electromechanical valve is disclosed. Upon receipt of an initiation signal, the driver circuit generates a predetermined current profile in a coil. A current sensing mechanism senses the current flowing through the coil, enabling a current threshold generator to detect a preset peak current threshold state. Upon detection of the preset peak current threshold state, the current threshold generator establishes a new hold current threshold state in the coil. A rapid decay generator forces a rapid transition from peak current to hold current within the coil. The hold current is maintained within preset hysteretic limits until the valve cycle is terminated by removing the initiation signal from the inputs.

17 Claims, 4 Drawing Sheets

ELECTROMECHANICAL VALVE DRIVER CIRCUIT AND METHOD

This application claims the benefit of U.S. Provisional Application No. 60/105,242 filed Oct. 22, 1998, which is hereby incorporated by reference in its entirety.

FIELD OF THE INVENTION

This invention relates to electromechanical valve control circuitry in general and particularly to driving circuitry for controlling single-coil fuel injectors. More particularly, this invention relates to a driver circuit and method for driving single-coil fuel injectors with a two-pin input connector.

BACKGROUND OF THE INVENTION

Minimizing heat generation is important for fuel injectors that inject high vapor pressure fuels such as, for example, Liquid Propane Gas (LPG). Excessive heat generation within LPG fuel injectors often results in vapor lock because LPG is highly volatile and can boil at relatively low temperatures. Vapor lock is an undesirable condition wherein fuel changes from a normally liquid state to a gaseous state within the fuel ring or injector body, obstructing the flow of liquid fuel and adversely affecting fuel metering and engine performance.

Dual-coil fuel injectors are known to reduce heat generation. However, dual-coil injectors require three connections to the Engine Control Unit (ECU), a common center tap and two control connections, in contrast, only two connections to the ECU are required for single-coil injectors. The dual-coil third connection results in increased cost and complexity owing to the need to precisely align the electrical leads from the coils through sealing o-rings to connector terminals during the assembly process. In addition, the dual-coil third connection necessitates additional wire and connector hardware in the injector harness, resulting in increased cost and complexity over single-coil designs.

Single-coil fuel injectors solve many of the manufacturing and hardware cost problems described above. However, prior single-coil injector driver circuits have been known to dissipate excessive energy in the form of heat within the injector coil, making them unsuitable for LPG applications due to the risk of vapor lock. Thus, a need exists for a highly efficient, self-triggered monostable single-coil fuel injector driver circuit suitable for use with LPG systems that delivers the performance normally associated with peak and hold drivers while actually being interfaced to an ECU that only provides a saturated transistor driver. Further, a need exists for a single-coil fuel injector driver circuit capable of being mounted within a single-coil LPG injector housing without causing excessive heat build up within the injector.

SUMMARY OF THE INVENTION

The present invention provides a fuel metering device actuated by an electromagnetic assembly. The electromagnetic assembly includes a coil and armature. A housing cinctures the fuel metering device. An electrical connector is disposed on the housing, the electrical connector includes two pins that are exposed to the exterior of the fuel injector. A self-triggering driver circuit is disposed within the housing. The driver circuit has two inputs, each operatively connected to one of the connector pins. The driver circuit is configured to generate a predetermined current profile in the coil upon an initiation signal. The initiation signal is created by generating an electrical potential between the connector pins. In a preferred embodiment, the fuel injector housing includes an over-molded member. In a preferred embodiment, the fuel injector is a liquid propane fuel injector.

In a preferred embodiment, the self-triggering driver circuit has a current source that generates a current in a electromechanical valve coil. A current sensor senses the current flowing through the coil. A current threshold generator, having a peak current threshold state, corresponding to a peak current value generated by the current source, and a hold current threshold state, corresponding to a hold current value generated by the current source, transitions from the peak current threshold state to the hold current threshold state when the current sensor senses a predetermined peak current flowing through the coil. A current regulator regulates the output of the current source according to the state of the current threshold generator. A rapid decay generator is activated upon transition of the current threshold generator from the peak current threshold state to the hold current threshold state. The rapid decay generator causes rapid current decay through the coil from the peak current value to the hold current value, thus minimizing the energy dissipated in the form of heat within the coil.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENTS

Figure 1:
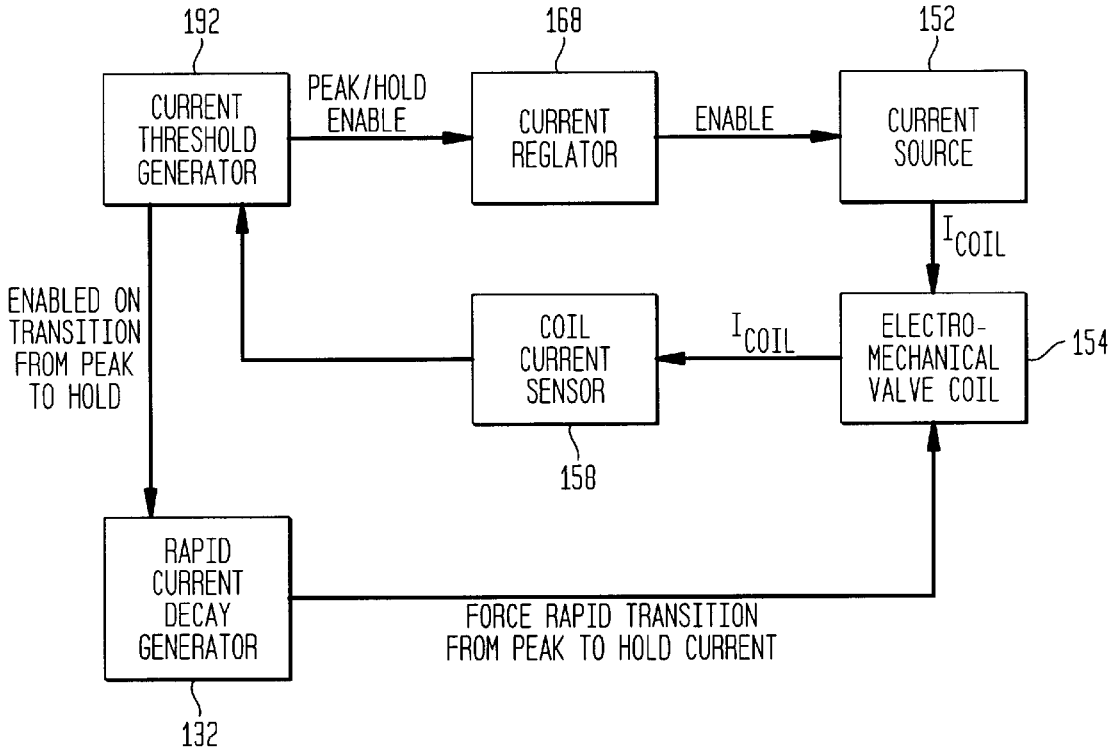
FIG. 1 is a functional block diagram of a electromechanical valve driver circuit embodying the principles of the present invention.

FIG. 1 is a functional block diagram illustrating the operation of the electromechanical valve driver circuit according to a preferred embodiment. The self-triggering driver circuit is preferably housed within a fuel injector having a connector with only two pins, as described below in reference to FIG. 6. A current source 152 feeding electromechanical valve coil 154 is controlled by a current regulator 168. A current threshold generator 192 establishes a peak current threshold for current regulator 168. Upon reaching a preset peak current threshold, the current threshold generator 192 establishes a hold current threshold while a rapid decay generator 132 simultaneously forces the current in the coil 154 to rapidly decay from the peak threshold value to the hold threshold value. The current regulator 168 maintains the current in the injector at the hold threshold value, within preset hysteretic limits, for the duration of the electromechanical valve cycle.

Figure 2:
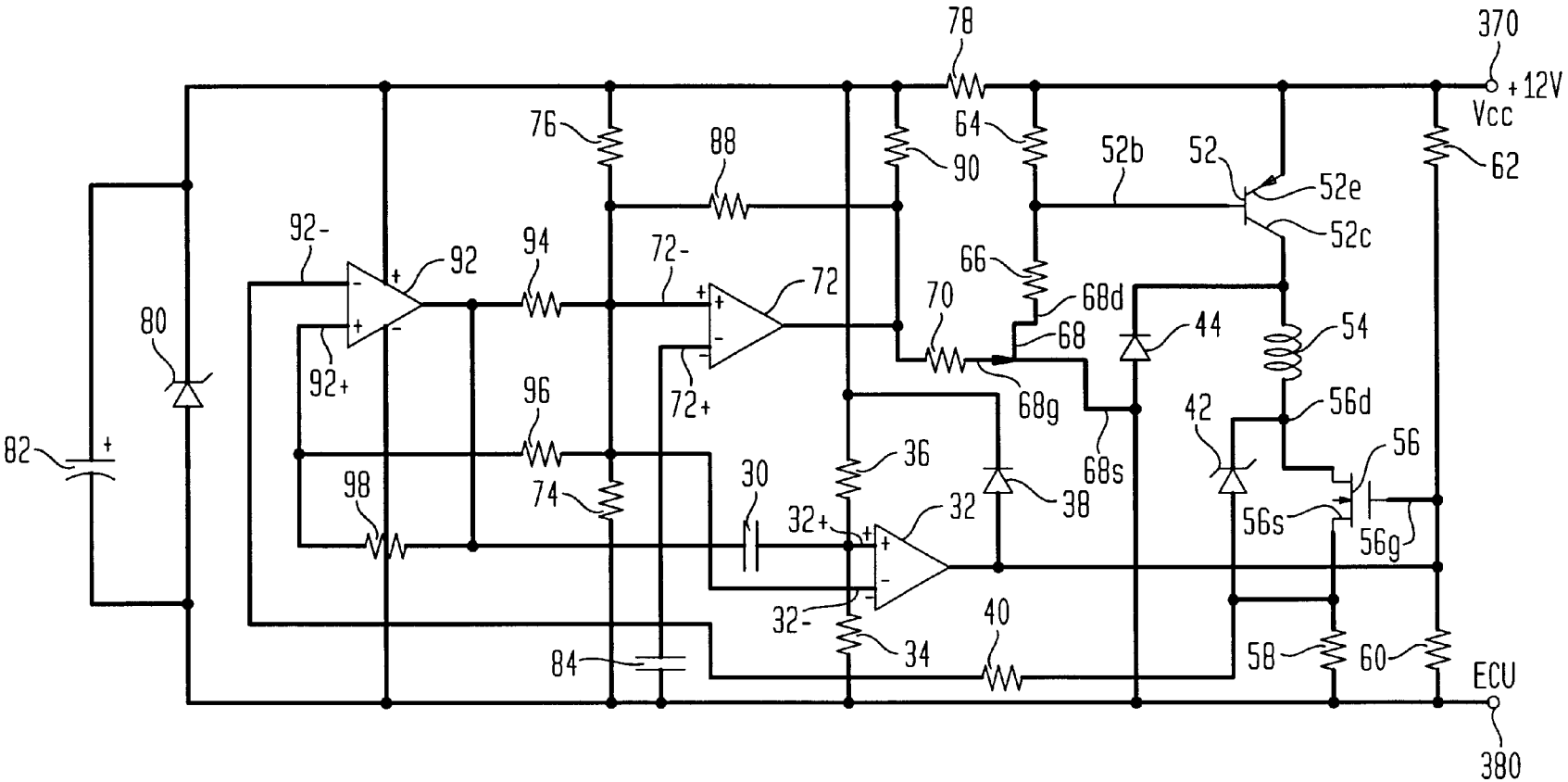
FIG. 2 illustrates a preferred embodiment of an electromechanical valve driver circuit according to the present invention.

FIG. 2 illustrates a preferred embodiment of the electromechanical valve driver circuit diagrammed in FIG. 1 in a Liquid Propane Gas (LPG) fuel injector application. Battery voltage Vcc, preferably about 12 volts, is provided to a first circuit input 370 located on a first end of regulator resistor 78, which is preferably 1K. The second end of resistor 78 is connected to the cathode of zener regulator 80, which is preferably 5.1 volts and 1 watt. The anode of zener regulator 80 is connected to a second circuit input 380 located on floating ground terminal ECU. The anode of electrolytic capacitor 82, which is preferably 1 uF, is connected to the cathode of zener regulator 80. The cathode of capacitor 82 is connected to ECU.

The main current string has current source transistor 52, which is a preferably PNP type, having emitter 52*e* connected to battery voltage Vcc and collector 52*c* connected to a first terminal of the injector coil 54 and to the cathode of recirculation diode 44. The anode of recirculation diode 44 is connected to ECU. The drain 56*d* of current sink transistor 56, which is preferably a MOSFET, is connected to a second terminal of the injector coil 54 and to the cathode of zener diode 42. The source 56*s* of transistor 56 is connected to a first end of sense resistor 58, which is preferably 0.5 ohm, 1%, and to the anode of zener diode 42. As will be appreciated by one skilled in the art, the drain and source connections of transistor 56 may be reversed. The second end of sense resistor 58 is connected to ECU. The gate 56g of transistor 56 is connected to a first end of bias resistor 60, which is preferably 27K, and to a first end of bias resistor 62, which is preferably 10K. The second end of resistor 60 is connected to ECU. The second end of resistor 62 is connected to Vcc.

The base 52*b* of transistor 52 is connected to a first end of bias resistor 64, which is preferably 680 ohms, and to a first end of bias resistor 66, which is preferably 100 ohms, 3 watts. The second end of resistor 64 is connected to Vcc. The second end of resistor 66 is connected to the drain 68*d* of current regulator transistor 68, which is preferably a JFET. The source 68*s* of transistor 68 is connected to ECU. The gate 68*g* of transistor 68 is connected to a first end of resistor 70, which is preferably 1K. The second end of resistor 70 is connected to the output of threshold regulating comparator 72.

The non-inverting input 72+ of comparator 72 is connected to a first end of resistor 74, which is preferably 4.75K, 1%, and to a first end of resistor 76, which is preferably 9.09K, 1%. The second end of resistor 74 is connected to ECU. The second end of resistor 76 is connected to the cathode of zener regulator 80. A first end of positive feedback resistor 88, which is preferably 43.2K, is connected to non-inverting input 72+ and the second end of resistor 88 is connected to the output of comparator 72. A first end of resistor 90 is connected to the output of comparator 72 and the second end of resistor 90 is connected to the cathode of zener regulator 80. The inverting input 72− of comparator 72 is connected to a first end of capacitor 84, which is preferably 10 nF. The second end of capacitor 84 is connected to ECU.

The output of comparator 92 is connected to a first end of resistor 94, which is preferably 1K, 1%, and a first end of capacitor 30, which is preferably 22 nF. The second end of resistor 94 is connected to non-inverting input 72+ of comparator 72. The non-inverting input 92+ of comparator 92 is connected to a first end of resistor 96, which is preferably 16K, and a first end of resistor 98, which is preferably 4.7K. The second end of resistor 96 is connected to the non-inverting input 72+ of comparator 72. The second end of resistor 98 is connected to the output of comparator 92. The inverting input 92− of comparator 92 is connected to the first end of capacitor 84.

The second end of capacitor 30 is connected to the non-inverting input 32+ of comparator 32 and to a first end of resistor 34, which is preferably 22K. The second end of resistor 34 is connected to ECU. The cathode of zener regulator 80 is connected to a first end of resistor 36, which is preferably 33K, and to the cathode of diode 38. The second end of resistor 36 is connected to the non-inverting input 32+ of comparator 32. The anode of diode 38 is connected to the output of comparator 32. A first end of resistor 40, which is preferably 1K, is connected to the first end of capacitor 84. The second end of resistor 40 is connected to the first end of sense resistor 58.

Figure 3:
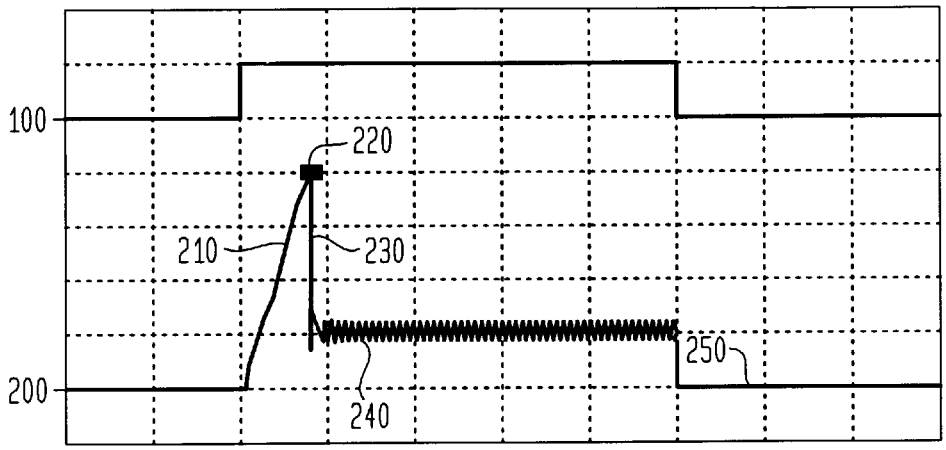
FIG. 3 is an oscilloscope trace illustrating a output current waveform according to the present invention.

Referring now to FIG. 3, the circuit described above generates substantially current profile 200 through injector coil 54 for the duration of injector driver pulse 100. The circuit is activated by an initiation signal that is created by placing a potential across the first and second circuit inputs, 370 and 380, respectively. The initiation signal may be created, for example, when injector driver pulse 100, generated within an engine control unit, causes terminal ECU 380 to become effectively grounded. Grounding of terminal ECU may be accomplished by any desired method, for example by saturation of an open collector switch within the engine control unit.

Upon effectively grounding terminal ECU, a positive voltage is applied to the gate 56*g* of current sink MOSFET transistor 56 by the voltage divider formed by resistors 60 and 62, forcing MOSFET 56 to conduct. Current supplied by current source PNP transistor 52 builds on the L/R time constant in the injector coil 54 and passes through current sense resistor 58. The voltage across current sense resistor 58 grows linearly in relation to the current flowing through the injector coil 54, in accordance with Ohm's Law.

A current regulator, which preferably includes JFET transistor 68 and comparator 72, supplies base current to PNP transistor 52 whenever the threshold voltage present at non-inverting input 72+ of comparator 72 exceeds the voltage across sense resistor 58. During the current incline period 210 in FIG. 3, the threshold voltage present at non-inverting input 72+ of comparator 72 is established primarily by the voltage divider formed by resistors 74 and 76.

A current threshold generator, which preferably includes comparator 92, resistor 94, and voltage divider formed by resistors 74 and 76, shunts the first end of 1K resistor 94 to ground when the voltage across the sense resistor 58 reaches a level corresponding to the desired peak current 220 in FIG. 3 through injector coil 54. This effectively places resistor 94 in parallel with resistor 74, and establishes a new lower threshold voltage at the non-inverting input 72+ of comparator 72, corresponding to the hold current level 240 in FIG. 3. As a consequence, the voltage at the inverting input 72− of comparator 72 will exceed the voltage at the non-inverting input 72+, forcing the gate 68*g* of JFET 68 to substantially ECU (ground) potential and removing the base current from current source PNP transistor 52, thereby making it non-conducting.

Simultaneously, a rapid decay generator, which preferably includes capacitor 30, comparator 32, zener diode 42, and MOSFET 56, triggers a one-shot timing pulse. The one-shot causes the voltage at inverting input 32– to exceed the voltage at non-inverting input 32+, and forces MOSFET 56 into a non-conducting state and isolates injector coil 54. Zener diode 42 clamps the injector coil/MOSFET drain junction at approximately 38 volts. Recirculation diode 44 clamps the PNP collector 52*c* to within about 0.7 volts of ECU ground, thereby protecting PNP transistor 56 by ensuring that the Vce breakdown voltage is not exceeded.

Figure 4:
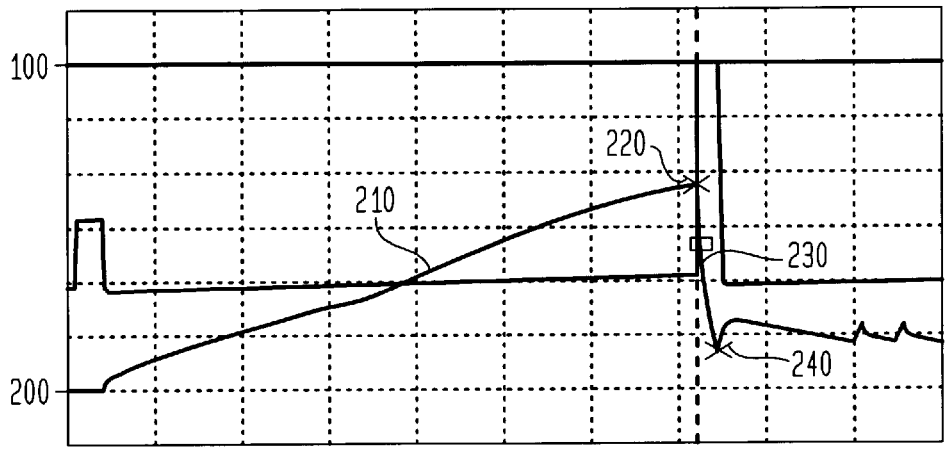
FIG. 4 is an oscilloscope trace illustrating a build-to-peak and peak-to-hold transition waveform according to the present invention.
Figure 5:
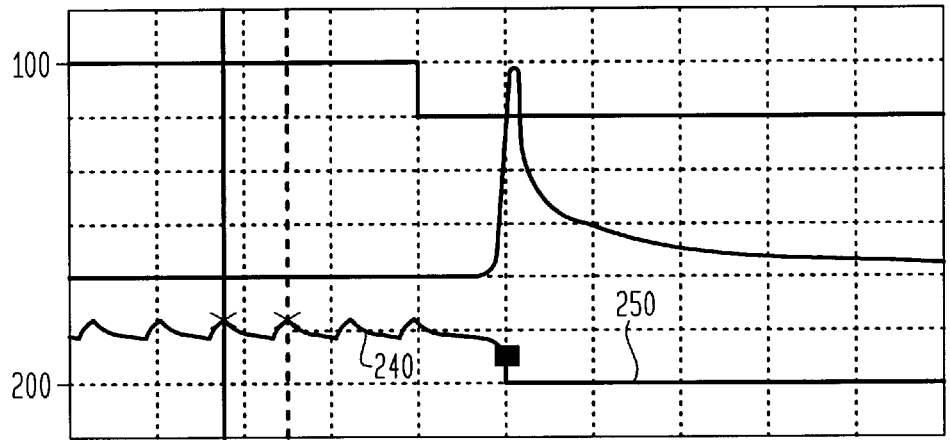
FIG. 5 is an oscilloscope trace illustrating a hold regulation and hold-to-off transition waveform according to the present invention.

The large zener voltage across the injector coil induces a large rate of change in the coil current. The rate of change of current through the injector coil 54 is governed by the equation $di/dt=-V/L$, where i is the current through the coil; di/dt is the instantaneous rate of change of the current through the coil; V is the voltage across the coil; and L is a constant representing the inductance of the coil. It can readily be seen from the above equation that increasing the voltage, V, will increase the rate of current decay, di/dt, through the injector coil 54. FIGS. 3 and 4 illustrate the rapid change 230 from the peak current threshold 220 to the hold current threshold 240.

Hysteresis in the hold current threshold state is governed by a dither control, which preferably includes positive feedback resistor 88 and comparator 72, together forming a Schmitt trigger. For the remainder of the injector pulse, dithering around the hold threshold current under control of the sense resistor 58 and recirculation diode 44 regulates the injector coil current. At the termination of the injection pulse, the saturated switch driver of the ECU removes terminal ECU from ground. This results in both PNP transistor 52 and MOSFET transistor 56 becoming non-conducting, causing the injector coil current to decay rapidly to zero 250 via zener diode 42 and recirculation diode 44.

Figure 6:
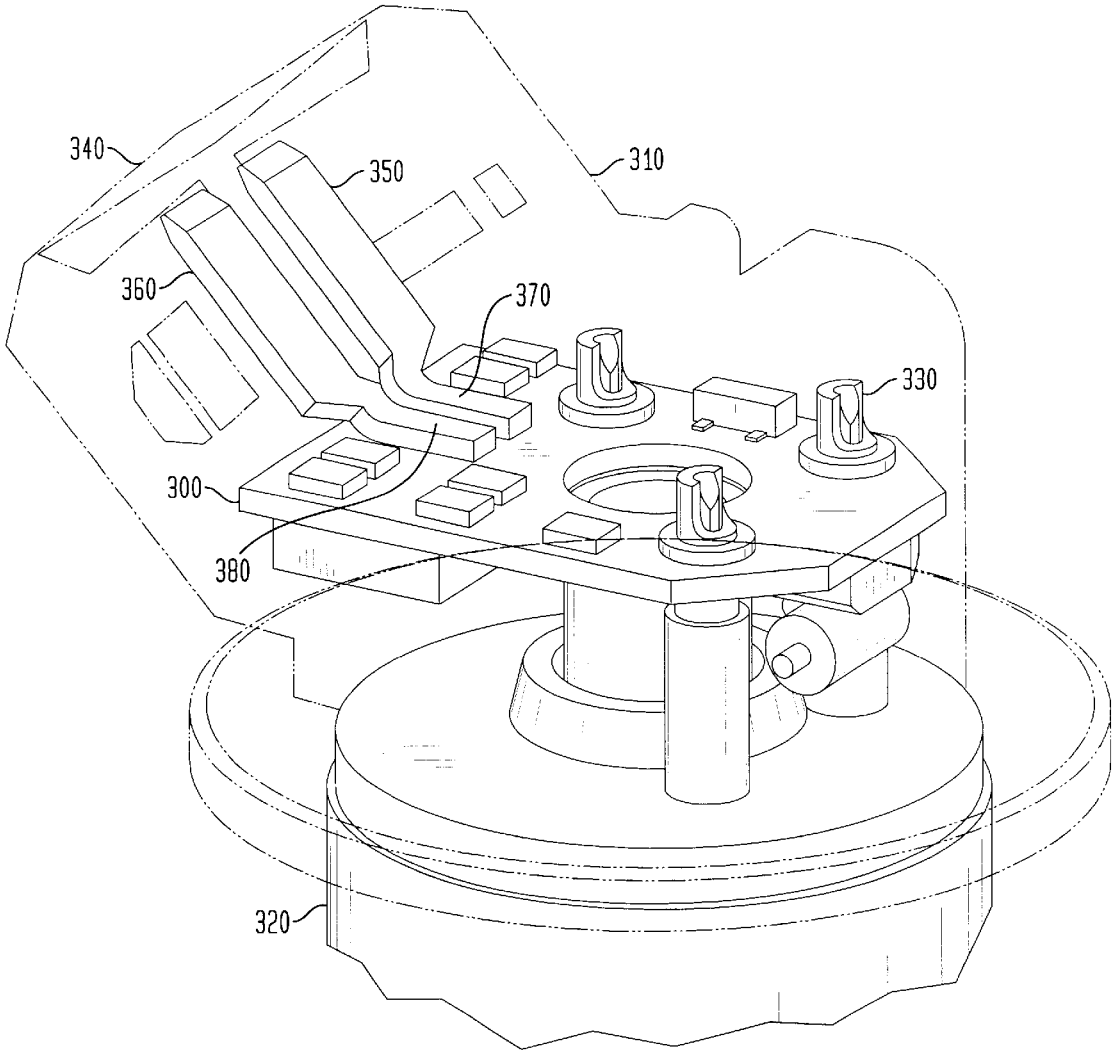
FIG. 6 illustrates a preferred packaging scheme for an embodiment of the invention enclosed within a fuel injector housing having two input pins mounted within an electrical connector.

FIG. 6 illustrates a preferred embodiment wherein the driver circuit 300 is mounted within a over-mold housing 310 of a fuel injector 320. The driver circuit 300 may be mounted to the injector 320 on fasteners 330. Over-mold housing 310 provides a hermetic seal against moisture and includes electrical connector 340 having connector pins 350 and 360 electrically connected to circuit inputs 370 and 380, respectively. Electrical connector 340 provides access for a wiring harness connector.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but have the full scope defined by the language of the following claims, and equivalents thereof

What I claim is:

1. A fuel injector comprising:

a fuel metering device actuated by an electromagnetic assembly, the electromagnetic assembly including a coil and an armature;

a housing cincturing the fuel metering device;

an electrical connector disposed on the housing, the electrical connector including a first pin and a second pin, the first pin and the second pin being exposed to an exterior of the fuel injector;

a self-triggering driver circuit disposed within the housing, the circuit having a first input and a second input, the first input being operatively connected to the first pin, the second input being operatively connected to the second pin, the driver circuit being configured to generate a predetermined current profile in the coil upon an initiation signal, the initiation signal being created by generating an electrical potential between the first pin and the second pin.

2. The fuel injector of claim 1, wherein the housing comprises an over-molded member.

3. The fuel injector of claim 1, wherein the fuel injector comprises a liquid propane fuel injector.

4. The fuel injector of claim 1, wherein the self-triggering driver circuit further comprises:

a current source electrically connected to the coil;

a current sensor coupled to the coil;

a current threshold generator having a peak current threshold state, corresponding to a peak current value generated by the current source, and a hold current threshold state, corresponding to a hold current value generated by the current source, wherein the current threshold generator transitions from the peak current threshold state to the hold current threshold state when the current sensor senses a predetermined peak current flowing through the coil;

a current regulator electrically connected to the current source, wherein the current regulator regulates the output of the current source according to the state of the current threshold generator; and a rapid decay generator that is activated upon transition of the current threshold generator from the peak current threshold state to the hold current threshold state, the rapid decay generator causing rapid current decay through the coil from the peak current value to the hold current value.

5. The electromechanical valve driver circuit according to claim 4, further comprising a current dither control; and wherein the current threshold generator comprises a first comparator, a voltage divider and a third resistor, the first comparator having a non-inverting input terminal, a inverting input terminal, and a output terminal; the voltage divider having a first resistor having a first junction end and a voltage source end and a second resistor having a second junction end and reference voltage end, wherein the first junction end is electrically connected to the second junction end, forming a junction, and wherein the voltage source end is connected to a voltage source, and the reference voltage end is connected to a reference voltage; the third resistor having a first end and a second end, wherein the first end is connected to the junction and the second end is connected to the output terminal, and wherein the junction voltage is determined according to the resistive values of the voltage divider when the voltage at the non-inverting input terminal is greater than the voltage at the inverting input terminal, and wherein the junction voltage changes in magnitude when the voltage at the non-inverting input terminal is less than the voltage at the inverting input terminal; and wherein the current regulator further comprises a first field effect transistor having a gate voltage controlled by a second comparator; and wherein the rapid decay generator further comprises a third comparator and a zener diode, the third comparator having a third output electrically connected to a gate of a second field effect transistor, the second field effect transistor having a drain connected to the coil and a source connected to the current sensor; the zener diode having a cathode connected to a drain of the second field effect transistor, and a anode connected to a source of the second field effect transistor, wherein when the third comparator triggers a one-shot pulse, the second field effect transistor is forced into a non-conducting state, and the zener diode clamps the drain of the second field effect transistor to a zener voltage; and wherein the current source comprises a bipolar junction transistor and the current sensor comprises a resistor.

6. A fuel injector having a self-triggering electromechanical valve driver, the fuel injector comprising:

a housing;

an electromechanical valve coil and an electromechnical valve driver circuit mounted in the housing, the circuit comprising a means for generating a current in a electromechanical valve coil;

a means for sensing the current flowing through the coil;

a means for current threshold generating, the current threshold generating means having a peak current threshold state, corresponding to a peak current value generated by the current generating means, and a hold current threshold state, corresponding to a hold current value generated by the current generating means, wherein the current threshold generating means transitions from the peak current threshold state to the hold current threshold state when the current sensing means senses a predetermined peak current flowing through the coil;

a means for regulating the output of the current generating means according to the state of the current threshold generating means; and a means for rapid decay generating, the rapid decay generating means being activated upon transition of the current threshold generating means from the peak current threshold state to the hold current threshold state, the rapid decay generator causing rapid current decay through the coil from the peak current value to the hold current value.

7. The fuel injector according to claim 6, wherein the circuit further comprises a two-terminal input means; and wherein the circuit is triggered by application of a voltage potential across the input means.

8. The fuel injector according to claim 7, further comprising a means for current dither control; and wherein the means for current threshold generating comprises a first comparator, a voltage divider and a third resistor, the first comparator having a non-inverting input terminal, a inverting input terminal, and a output terminal; the voltage divider having a first resistor having a first junction end and a voltage source end and a second resistor having a second junction end and reference voltage end, wherein the first junction end is electrically connected to the second junction end, forming a junction, and wherein the voltage source end is connected to a voltage source, and the reference voltage end is connected to a reference voltage; the third resistor having a first end and a second end, wherein the first end is connected to the junction and the second end is connected to the output terminal, and wherein the junction voltage is determined according to the resistive values of the voltage divider when the voltage at the non-inverting input terminal is greater than the voltage at the inverting input terminal, and wherein the junction voltage changes in magnitude when the voltage at the non-inverting input terminal is less than the voltage at the inverting input terminal; and wherein the means for regulating the output of the current generating means comprises a first field effect transistor having a gate voltage controlled by a second comparator; and wherein the means for rapid decay generating further comprises a third comparator and a zener diode, the third comparator having a third output electrically connected to a gate of a second field effect transistor, the second field effect transistor having a drain connected to the coil and a source connected to the current sensor; the zener diode having a cathode connected to a drain of the second field effect transistor, and a anode connected to a source of the second field effect transistor, wherein when the third comparator triggers a one-shot pulse, the second field effect transistor is forced into a non-conducting state, and the zener diode clamps the drain of the second field effect transistor to a zener voltage; and wherein the means for generating a current comprises a bipolar junction transistor and wherein the means for sensing the current comprises a resistor.

9. The fuel injector according to claim 8, wherein the electromechanical valve comprises a liquid propane fuel injector.

10. A method of driving a fuel injector, the method comprising the steps of:

starting a injection cycle by generating a voltage potential across a two-pin connector mounted on a fuel injector;

generating a current in a electromechanical valve coil;

sensing the current flowing through the coil;

generating a peak current threshold state, corresponding to a peak current value flowing through the coil, and a hold current threshold state, corresponding to a hold current value flowing through the coil;

rapidly transitioning from the peak current threshold state to the hold current threshold state upon sensing a predetermined peak current flowing through the coil;

maintaining the hold current threshold state for a variable finite period; and terminating the injection cycle by removing the voltage potential across the two-pin connector mounted on the fuel injector.

11. The method of driving a fuel injector according to claim 10, wherein the fuel injector comprises a liquid propane fuel injector.

12. The method of driving fuel injector according to claim 10, wherein the step of rapidly transitioning from the peak current threshold state to the hold current threshold state upon sensing a predetermined peak current flowing through the coil farther includes the steps of providing a comparator having a output electrically connected to a gate of a field effect transistor, the field effect transistor having a drain connected to the coil and a source connected to the current sensor;

providing a zener diode having a cathode connected to a drain of the field effect transistor, and a anode connected to a source of the field effect transistor;

triggering a one-shot pulse;

forcing the field effect transistor into a non-conducting state; and clamping the drain of the second field effect transistor to a zener voltage.

13. A method of driving a electromechanical valve coil of the fuel injector, the method comprising:

providing a housing for the fuel injector;

mounting the electromechnical valve coil and driving circuitry substantially with the housing;

generating a current in a electromechanical valve coil;

sensing the current;

adjusting the current to increase at a predetermined rate of increase until a predetermined peak current value is sensed;

rapidly decreasing the current at a predetermined rate of decay until a predetermined hold current value is sensed; and holding the current at the predetermined hold current value within predetermined hysteretic limits for a variable finite period.

14. The method of driving an electromechanical valve coil according to claim 13, wherein the average predetermined rate of increase comprises a range of 1.0 to 1.5 mA/second, the predetermined peak current value comprises a range of 3 to 5 amperes, the average predetermined rate of decay comprises at least 64,000 amperes/second, the predetermined hold current value comprises a range of 0.5 to 1.5 amperes, and the predetermined hysteretic limits comprises a range of 0.1 to 0.2 amperes.

15. A fuel injector having a self-triggering electromechanical valve driver, the fuel injector comprising:

a housing;

an electromechanical valve coil and an electromechanical valve driver circuit mounted in the housing, the circuit comprising a current generator electrically connected to a electromechanical coil;

a current sensor coupled to the coil; and a rapid current decay generator that is activated upon sensing a predetermined peak current in the coil, the rapid decay generator rapidly decreasing the current at a predetermined rate of decay until a predetermined hold current value is sensed within predetermined hysteretic limits.

16. The fuel injector according to claim 15, wherein the current generator comprises a PNP transistor; and wherein the driver circuit is mounted in a fuel injector; and wherein the current sensor comprises a resistor; and wherein the rapid decay generator comprises a zener diode; and wherein the predetermined hysteretic limits are controlled by a Schmitt trigger.

17. The fuel injector according to claim 15, wherein the predetermined peak current value comprises a range of 3 to 5 amperes, the average predetermined rate of decay comprises at least 64,000 amperes/second, and the predetermined hold current value comprises a range of 0.5 to 1.5 amperes, the predetermined hysteretic limits comprises a range of 0.1 to 0.2 amperes.

* * * * *